US006138623A

United States Patent [19]

Heer

[11] Patent Number: 6,138,623

[45] Date of Patent: Oct. 31, 2000

[54] DEVICE FOR ADJUSTING THE PHASE ANGLE OF A CAMSHAFT

[75] Inventor: Siegfried Heer, Kirchdorf/Krems, Austria

[73] Assignee: TCG Unitech Aktiengesellschaft, Kirchdorf/Krems, Austria

[21] Appl. No.: 09/176,879

[22] Filed: Oct. 21, 1998

[30] Foreign Application Priority Data

Oct. 21, 1997 [AT] Austria ..... 1778/97
Aug. 20, 1998 [AT] Austria ..... 1422/98

[51] Int. Cl.[7] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 3,103,209 | 9/1963 | Bekkala et al. . | |
| 4,091,776 | 5/1978 | Clemens et al. | 123/90.15 |
| 4,627,825 | 12/1986 | Bruss et al. . | |
| 5,189,999 | 3/1993 | Thoma | 123/90.17 |
| 5,247,914 | 9/1993 | Imai et al. | 123/90.17 |
| 5,293,845 | 3/1994 | Yamazaki et al. . | |
| 5,329,890 | 7/1994 | Mueller | 123/90.17 |

FOREIGN PATENT DOCUMENTS

| | | |
|---|---|---|
| 0363600 | 4/1990 | European Pat. Off. . |
| 0781899 | 7/1997 | European Pat. Off. . |
| 3929619 | 3/1991 | Germany . |
| 4101676 | 7/1992 | Germany . |
| 4110088 | 7/1992 | Germany . |
| 4237193 | 5/1994 | Germany . |

*Primary Examiner*—Weilun Lo
*Attorney, Agent, or Firm*—Dykema Gossett PLLC

[57] ABSTRACT

A device for adjusting the phase angle of a camshaft of an internal combustion engine relative to the camshaft driving gear includes a hydraulic adjusting element which is connected with both a member supporting the drive gear and a member rigidly connected to the camshaft. Simple and reliable adjustment of the camshaft phase is obtained by providing the hydraulic adjusting element with a hydraulic pumping member which is driven by the drive gear, and a driving member connected to the camshaft, which is hydraulically driven by the pumping member, the outlet end of the pumping member being flow-connected to the inlet end of the driving member and the flow volume and/or pressure of the working fluid delivered from the pumping member to the driving member being regulated.

12 Claims, 2 Drawing Sheets

Fig. 1
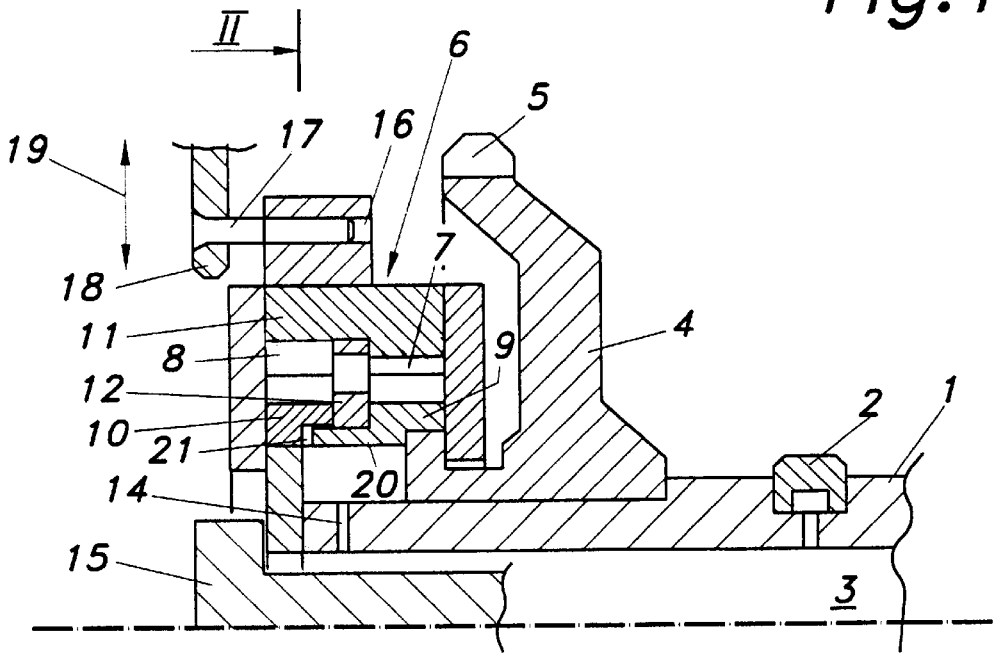
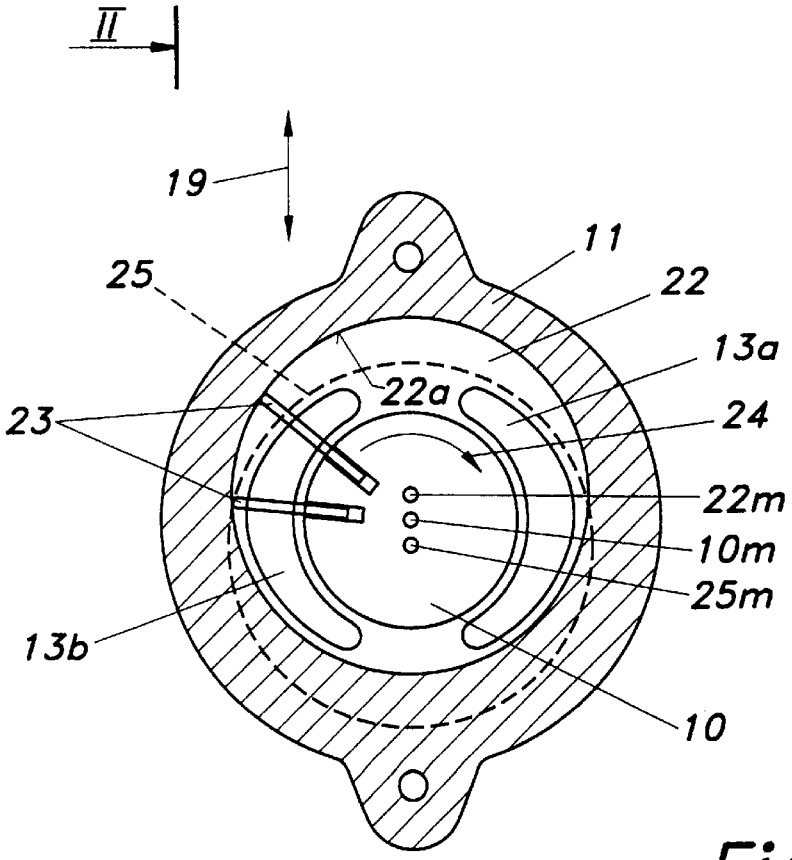
Fig. 2

DEVICE FOR ADJUSTING THE PHASE ANGLE OF A CAMSHAFT

BACKGROUND OF THE INVENTION

The invention relates to a device for adjusting the phase angle of a camshaft of an internal combustion engine relative to the camshaft driving gear, including a hydraulic adjusting element which is connected to both a member supporting the drive gear and a member rigidly connected to the camshaft.

DESCRIPTION OF THE PRIOR ART

To obtain optimum values for fuel consumption and exhaust emissions in different regions of the engine operating characteristics, the valve timing must be varied in dependence of different operating parameters. An elegant manner of varying the valve timing is realized by rotating the camshaft relative to its driving gear. The camshaft of an internal combustion engine usually is driven by a sprocket wheel, which is connected to the crankshaft via a drive chain, or a drive gear configured as a pulley, which is connected to the crankshaft via a toothed belt.

In U.S. Pat. No. 4,091,776 a camshaft drive mechanism is described, where the camshaft is adjusted by forcing oil into the space between two rotary pistons. During adjustment the entire driving torque of the camshaft must be overcome, which will put a strong load on the oil circulation system. In order to ensure a reliable supply of lubricating oil in all operating conditions of the engine, a significantly stronger oil pump must be provided, which will raise cost and increase fuel consumption.

Similar considerations apply to mechanisms as described in EP 0 781 899 A, or U.S. Pat. No. 3,103,209.

In DE 41 10 088 Cl and DE 39 29 619 Al adjusting mechanisms are described where an adjusting element is provided between a member connected with the camshaft and a member connected with the drive gear, which element has two helical threads meshing with corresponding threads of the camshaft or the drive gear. By axially displacing this adjusting element the camshaft can be turned relative to its driving gear. Axial displacement of the adjusting element may be obtained by operation of a hydraulic plunger which is activated in dependence of the desired adjustment. The disadvantage of this solution is that the forces required can only be attained with a large hydraulic plunger necessitating considerable constructional expense.

An electric adjusting device is presented in DE 41 01 676 A1, where an electric motor is provided for displacing the adjusting element by means of a threaded spindle. As the adjusting element rotates essentially at camshaft speed, an axial thrust bearing must be provided between the electric motor and the adjusting element, which takes up the relative movement between the non-rotating and the rotating member. In the above solution the thrust bearing is more or less permanently subject to load, as the torsional moments acting between drive gear and camshaft will produce a force acting on the adjusting element in axial direction. For this reason the thrust bearing is a critical component which will limit the useful life of the engine.

The disadvantage of previous adjusting mechanisms of both the hydraulic and electric type is that an external energy source is required, either in the form of a hydraulic pump or an electric motor. This will raise production cost, increase the construction volume and reduce the overall efficiency of the internal combustion engine.

SUMMARY OF THE INVENTION

It is an object of this invention to overcome the above disadvantages and to create a simple, reliable and compact device for adjusting the camshaft phase. In particular, adjustment should be possible with the use of a minimum amount of external energy.

In accordance with the invention this object is achieved by providing the hydraulic adjusting element with a hydraulic pumping member which is driven by the drive gear, and a driving member connected to the camshaft, which is hydraulically driven by the pumping member, the outlet end of the pumping member being flow-connected to the inlet end of the driving member and the flow volume and/or pressure of the working fluid delivered from the pumping member to the driving member being regulated. The rotation of the camshaft relative to the drive gear is effected by the work transmitted from the driving member to the camshaft, the driving member being driven hydraulically via a working fluid delivered by the pumping member. The pumping member is driven via the drive gear of the camshaft.

It is provided in a preferred variant that the pumping member and the driving member be configured as positive displacement machines. It would also be possible, however, to configure pumping member and driving member as turbo-machines.

In an especially preferred variant of the displacement machines the pumping member and the driving member each are provided with a rotating vane cell impeller coaxial with the camshaft axis, the two impellers preferably sharing a common housing. This arrangement will permit a most compact and reliable design, where the vane cell impellers may be positioned axially side by side.

Controlling the phase angle of the camshaft relative to its driving gear is facilitated by providing that the flow volume and/or pressure of the working fluid delivered from the pumping member to the driving member should be regulated by linearly shifting the common housing transversely to the direction of the camshaft axis. By shifting the housing the displacement volumes in the pumping member and the driving member are increased or reduced in their relation to each other, such that a phase shift will take place between camshaft and drive gear. The maximum phase shift is limited by a stop provided between drive gear and camshaft.

In an alternative variant of the invention the proposal is made that the hydraulic adjusting element be provided with a housing containing a vane cell impeller configured as a pumping member, which is coaxial with the camshaft axis and will hydraulically drive another vane cell impeller configured as a driving member, which latter also is coaxial with the camshaft axis, the outlet end of the pumping member being flow-connected to the inlet end of the driving member, and the flow volume and/or pressure of the working fluid delivered from the pumping member to the driving member being regulated, and further that regulation of the flow volume and/or pressure of the working fluid delivered from the pumping member to the driving member should be effected by rotating the common housing about an axis parallel to the axis of the camshaft. Such a rotation will produce a similar effect as the linear shift referred to above, whilst driving the housing in the direction of rotation may be achieved more simply in some instances.

By eccentrically rotating the housing about an axis which is parallel to the camshaft axis but at a distance therefrom, the housing will turn along a circular arc. Depending on the configuration of the transfer openings, the torque transmitted from the drive gear to the camshaft will thus exert a small torque on the housing to turn the latter in a certain direction. This effect may be utilized to compensate any frictional forces or moments, or to facilitate, and thus accelerate, adjustment of the camshaft phase in a given direction. If desired, this effect may be increased or diminished by means of a spring element configured as a torsion spring.

To limit the maximum torque between drive gear and camshaft it is further provided that the flow connection between pumping member and driving member should be connected with an overflow oil line via a pressure relief valve.

The device described by the invention does not include a helical thread as required in axially operating adjusting mechanisms, which will reduce manufacturing cost. The adjusting energy is provided by the camshaft drive itself, and no external energy sources, such as additional electric motors or hydraulic pumps, will be required. Control of the phase adjustment is accomplished in a most simple manner, for example, by mechanical or electrical means, employing extremely small adjusting forces. Another advantage is offered by the universal use of the adjusting device in engines of various sizes and ratings. This will significantly reduce manufacturing cost.

Special preference is given to a variant including a working chamber for the pumping member and a working chamber for the driving member, which working chambers are arranged so as to be displaced in opposite directions relative to the camshaft axis. Advantageously, the flow connection between pumping member and driving member is established by openings in a partition between pumping member and driving member. In a neutral position of the housing, the pumping member will deliver to the driving member a predefined amount of oil through one opening, whilst drawing an equal amount of oil from the driving member through the other opening, for each rotation of the camshaft. The opposite applies with regard to the driving member, while the quantity of oil put through remains the same. As a consequence, pumping member and driving member will rotate at the same speed. No adjusting process takes place. In a shift from the neutral position conditions will change in that the oil volume passing through the pumping member during each rotation will vary with the degree of the shift, whilst the volume passing through the driving member will vary in the reverse sense. In this manner a relative movement is effected between pumping member and driving member, which will cause the phase of the camshaft to change. Compared to a theoretically possible, simplified variant, in which the working chambers of pumping member and driving member are concentric with the camshaft axis in a neutral position, the above variant has the advantage of smaller pressure peaks. Moreover, the oil flow passage between pumping member and driving member is of a particularly simple configuration and a more uniform heat distribution is accomplished.

DESCRIPTION OF THE DRAWINGS

The invention will now be described further, with reference to the accompanying drawings, in which FIG. 1 is a section through an embodiment of the invention illustrating the principal layout, FIG. 2 is a section along line II—II in FIG. 1.

DETAILED DESCRIPTION OF THE PREFERRED EMBODIMENT

Figure 3:
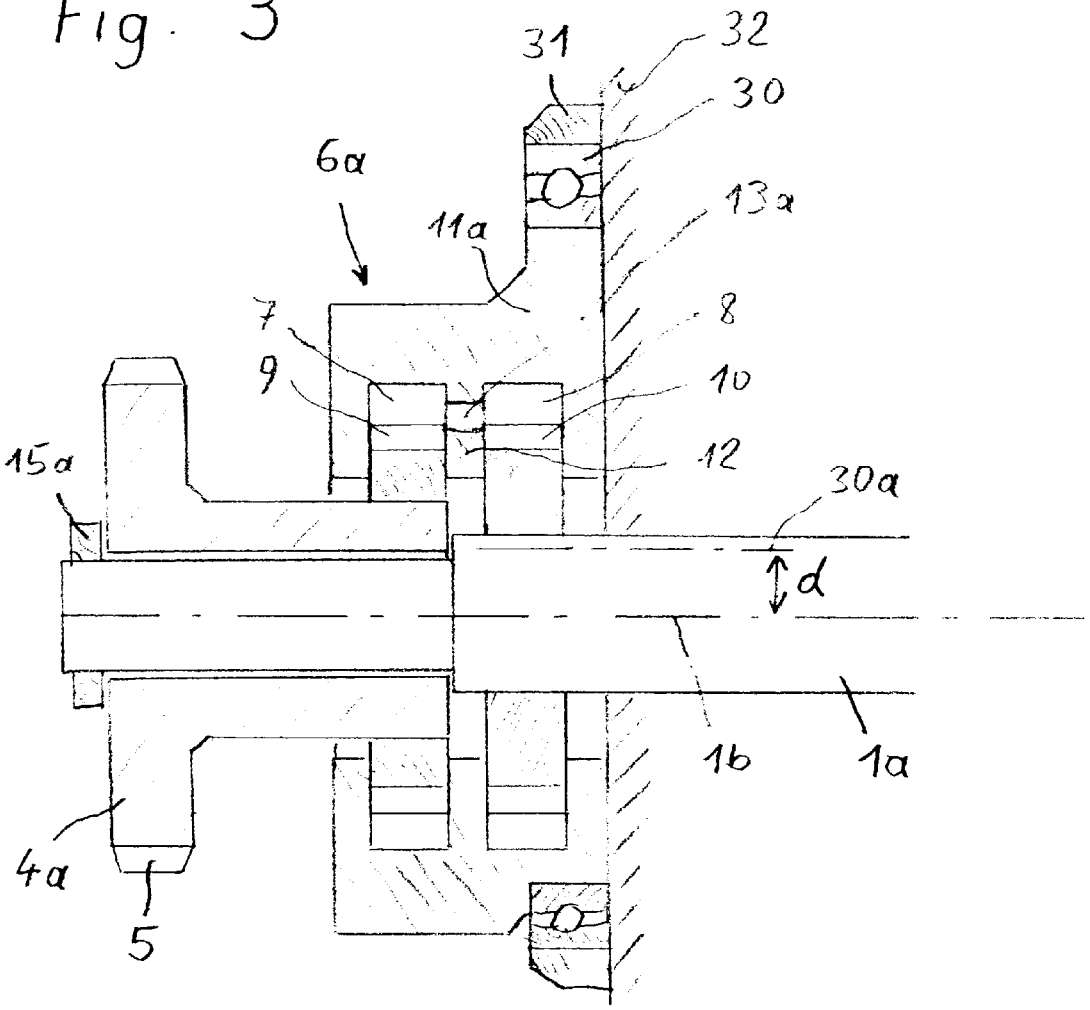
FIG. 3 shows a specially preferred variant of the invention.

FIG. 1 is a schematic, partial representation of a camshaft 1. Via an oil supply element 2 a bore 3 inside the camshaft 1 is supplied with lubricating oil. A drive gear 4 is mounted on the camshaft 1 such that it is axially fixed while being rotatable. The drive gear 4 has teeth 5 for engagement with a drive chain not shown here.

A hydraulic adjusting element is generally referred to as 6. The adjusting element 6 comprises a pumping member 7 and a driving member 8. The pumping member 7 includes a vane cell impeller 9, which is rigidly connected to the drive gear 4. In the driving member 8 is provided a corresponding vane cell impeller 10, which is rigidly connected to the camshaft 1. Pumping member 7 and driving member 8 have a common housing 11, which is non-rotatable but may be moved to and fro transversely to the axis of rotation. The housing 11 has a partition 12 separating the pumping member 7 from the driving member 8. Transfer openings 13*a*, 13*b* connect pumping member 7 and driving member 8. The adjusting element 6 is supplied with oil via a bore 14, which is connected to the longitudinal bore 3 of the camshaft 1. The adjusting element 6 is mechanically fastened on the camshaft 1 by means of a screw element 15. In a bore 16 of the housing 11 of the adjusting element 6 a pin 17 is inserted, which is coupled to an actuating rod 18 in order to move the housing 11 to and fro in the direction of double arrow 19. Adjustment is effected by an element not shown here, which is operated electrically or pneumatically or hydraulically. The adjusting forces required are very small, since more or less the only forces to be overcome are frictional forces. The actual energy for adjustment is gained from the torque transmitted via the drive gear 4.

In order to limit the adjustment range and to ensure reliable operation even if the adjusting element 6 is not yet completely filled with oil after a cold start, a projection 20 is provided on the pumping member 7, which engages in a corresponding slot 21 on the driving member 8. The play between projection 20 and slot 21 serves to define the adjusting range of the camshaft 1.

Following is a description of the operation of the mechanism proposed by the invention. FIG. 2 is a section through the driving member 8. The housing 11 contains a working chamber 22 which is eccentric to the impeller 10 of the driving member 8. Sliding vanes 23 of the impeller 10 pass along the interior periphery 22*a* of the working chamber 22. For reasons of simplicity only two sliding vanes 23 are shown in FIG. 2, whereas a plurality of sliding vanes are evenly spaced along the circumference of the impeller 10 in reality. The working chamber 22 has the shape of a circular cylinder, the axis 22*m* of the working chamber 22 being at a distance from the axis 10*m* of the impeller 10, which axis 10*m* also constitutes the axis of the camshaft 1. The direction of rotation of the camshaft is indicated by arrow 24. If the camshaft rotates in this direction, oil is drawn from the working chamber 22 of the impeller 10 through opening 13*a*, while oil is forced into the working chamber 22 through opening 13*b*. This will cause the impeller 10 to rotate. The impeller 9 of the pumping member 7 is coaxial with the impeller 10 of the driving member 8 and is not shown in FIG. 2. A working chamber 25 of the pumping member 7 is represented by a broken line in FIG. 2. The working chamber 25 is displaced relative to the impeller 9, its axis 25*m* having the same distance from the axis 10*m* in the neutral position of the housing 11 as the axis 22*m* of the working chamber 22. It is displaced in the opposite direction, however. By the rotation of the impeller 9 of the pumping member 7 in the direction of arrow 24 the oil is induced to flow through opening 13*b* from the pumping member 7 into the driving member 8, and, as regards the suction flow, through opening 13*a* from the driving member 8 into the pumping member 7. In the neutral position of the housing 11 a state of equilibrium will prevail if pumping member 7 and driving member 8 rotate at the same speed. As a consequence, there will be no adjustment of the camshaft 1 relative to the drive gear 4 in this position. After a cold start it may be assumed that the camshaft 1 is essentially carried along by the projection 20 pressing against a flank of the slot 21. For this reason the valve timing is set at "late". If the housing 11 is moved downwards from the neutral position, the eccentricity of the pumping member 7, and thus the pumping action per rotation, will increase. At the same time less oil will be received per rotation in the driving member 8. This will cause an advancing movement of the driving member 8 relative to the pumping member 7, which in turn will lead to a preliminary adjustment of the camshaft 1 relative to the drive gear 4. Such preliminary adjustment is halted by returning the housing 11 to the neutral position. Since there are essentially no forces acting on the housing 11 in the direction of movement, only a minimum of forces will be required for adjustment.

The prevailing phase angle of the camshaft 1 relative to the drive gear 4 may be determined by means of a Hall element, in a manner known in the art, such that precise adjustment of the phase angle may be achieved even in the presence of various inaccuracies.

FIG. 3 shows an especially preferred variant of the invention; the same components, or components with the same functions as above have the same reference numbers.

On the camshaft 1*a*, a drive gear 4*a* with teeth 5 is mounted so as to be coaxial with and rotatable relative to the camshaft. The drive gear 4*a* is axially secured by means of a screw element 15*a*. In analogy to the variant described above, the housing 11*a* of the hydraulic adjusting element 6*a* contains a vane cell impeller 9, which is rigidly connected to the drive gear 4*a*, and a vane cell impeller 10, which is rigidly connected to the camshaft 1*a*. Impellers 9 and 10 constitute the main elements of the pumping member 7 and driving member 8. The housing 11*a* is eccentrically attached to the cylinder head of an internal combustion engine, via a rolling bearing 30 and supporting elements 31. The cylinder head 32 is not shown in detail. The axis 30*a* of the rolling bearing 30 is parallel to the axis 1*b* of the camshaft 1*a*, and is displaced relative thereto by a distance d. By rotating the housing 11*a*, the hydraulic adjusting element 6*a* may be moved out of the neutral position shown in FIG. 3. Depending on the distance by which the housing 11*a*is moved from the neutral position, a relative movement is effected between the impellers 9 and 10, which will result in a phase change of the camshaft 1*a*.

The angle through which the housing 11*a* is rotated about the axis 30*a*, may be between 60 and 240 degrees, depending on the respective variant and magnitude of the eccentricity d. Movement in the direction of rotation may be achieved by various means. Preference is given to an electric stepper motor, or hydraulic adjustment by means of an adjusting element which is driven by the oil pressure of the engine. If an electric drive is used, preference is given to a design where the housing 11*a* is rigidly connected to the rotor of an electric motor not shown here, or is integral with it. In this way a particularly simple and robust construction will be obtained.

The special advantage of this invention is that the driving energy needed for adjustment of the camshaft phase is supplied by the camshaft drive itself. As the adjusting forces coming from external sources are extremely small, correspondingly small, low-energy adjusting elements may be used, which will take up very little space and may be produced at low cost.

What is claimed is:

1. Device for adjusting the phase angle of a camshaft of an internal combustion engine relative to a camshaft drive gear, comprising a hydraulic adjusting element which is connected to both a member supporting the drive gear and a member rigidly connected to the camshaft, wherein the hydraulic adjusting element is provided with a hydraulic pumping member which includes a first rotating vane cell impeller that is driven by the drive gear, and a driving member which includes a second rotating vane cell impeller connected to the camshaft, said first and second rotating vane cell impellers being coaxial with an axis of said camshaft and being located in a common housing, said second rotating vane cell impeller being hydraulically rotated by rotation of said first rotating vane cell impeller, an outlet end of the pumping member being flow-connected to an inlet end of the driving member and the flow volume and/or pressure of the working fluid delivered from the pumping member to the driving member being regulated, and means to move said housing relative to said pumping member and said driving member.

2. Device as claimed in claim 1, wherein the pumping member and the driving member are configured as positive displacement machines.

3. Device as claimed in claim 1, wherein the movement of the common housing is actuated hydraulically via the engine oil pressure.

4. Device as claimed in claim 1, wherein the flow volume and/or pressure of the working fluid delivered from the pumping member to the driving member are regulated by linearly shifting the common housing transversely to the axis of the camshaft.

5. Device as claimed in claim 1, wherein the shifting or rotation of the common housing is actuated electrically.

6. Device as claimed in claim 1, wherein the housing includes a working chamber for the pumping member and a working chamber for the driving member, which working chambers are located on opposite sides of the camshaft axis.

7. Device as claimed in claim 1, wherein the flow connection between pumping member and driving member is established by openings in a partition between pumping member and driving member.

8. Device as claimed in claim 1 wherein regulation of the flow volume and/or pressure of the working fluid delivered from the pumping member to the driving member is effected by rotating the common housing about an axis parallel to the axis of the camshaft.

9. Device as claimed in claim 8, wherein the housing includes a working chamber for the pumping member and a working chamber for the driving member, which working chambers are located on opposite sides of the camshaft axis.

10. Device as claimed in claim 8, wherein the flow connection between pumping member and driving member is established by openings in a partition between pumping member and driving member.

11. Device as claimed in claim 8, wherein the shifting or rotation of the common housing is actuated electrically.

12. Device as claimed in claim 8, wherein the rotation of the common housing is actuated hydraulically via the engine oil pressure.

* * * * *